US009410428B2

(12) United States Patent
Lucas et al.

(10) Patent No.: US 9,410,428 B2
(45) Date of Patent: Aug. 9, 2016

(54) TURBOMACHINE WITH CLAMP COUPLING SHAFT AND ROTOR HUB TOGETHER

(71) Applicant: United Technologies Corporation, Hartford, CT (US)

(72) Inventors: James L. Lucas, Hamden, CT (US); Matthew B. Kennedy, Vernon, CT (US); John E. Holowczak, S. Windsor, CT (US); William K. Tredway, Manchester, CT (US); Aavo Anto, Bridgeport, CT (US)

(73) Assignee: United Technologies Corporation, Hartford, CT (US)

( * ) Notice: Subject to any disclaimer, the term of this patent is extended or adjusted under 35 U.S.C. 154(b) by 896 days.

(21) Appl. No.: 13/726,946

(22) Filed: Dec. 26, 2012

(65) Prior Publication Data

US 2014/0178196 A1 Jun. 26, 2014

(51) Int. Cl.

| | |
|---|---|
| ***F01D 5/06*** | (2006.01) |
| ***F01D 5/02*** | (2006.01) |
| ***F01D 5/28*** | (2006.01) |
| ***F01D 5/34*** | (2006.01) |

(52) U.S. Cl.

CPC ..... *F01D 5/025* (2013.01); *F01D 5/066* (2013.01); *F01D 5/284* (2013.01); *F01D 5/34* (2013.01); *F05D 2260/37* (2013.01); *F05D 2300/175* (2013.01)

(58) Field of Classification Search

CPC ..... F01D 5/284; F01D 5/025; F01D 5/005; F01D 5/066; F01D 5/021; F01D 5/081; F01D 5/087

See application file for complete search history.

(56) References Cited

U.S. PATENT DOCUMENTS

| | | | | |
|---|---|---|---|---|
| 1,959,220 | A * | 5/1934 | Robinson | F01D 5/021 403/365 |
| 3,905,723 | A | 9/1975 | Torti, Jr. | |
| 3,943,703 | A * | 3/1976 | Kronogard | F01D 5/025 415/217.1 |
| 4,011,295 | A | 3/1977 | Tree et al. | |
| 4,011,737 | A | 3/1977 | Kruger et al. | |
| 4,076,456 | A | 2/1978 | Tree et al. | |
| 4,102,603 | A | 7/1978 | Smith et al. | |
| 4,123,199 | A * | 10/1978 | Shimizu | F01D 5/066 416/198 A |
| 4,176,519 | A | 12/1979 | Kronogard | |
| 4,247,256 | A | 1/1981 | Maghon | |
| 4,272,954 | A | 6/1981 | Kronogard | |
| 6,250,883 | B1 * | 6/2001 | Robinson | F01D 5/025 416/198 A |
| 6,431,781 | B1 | 8/2002 | Schenk | |
| 2007/0177937 | A1 | 8/2007 | Holowczak et al. | |
| 2007/0237646 | A1 * | 10/2007 | Shi | F01D 5/025 416/244 A |
| 2010/0290904 | A1 | 11/2010 | Wilson | |

FOREIGN PATENT DOCUMENTS

| | | |
|---|---|---|
| EP | 0052913 | 6/1982 |
| EP | 0112146 | 6/1984 |

OTHER PUBLICATIONS

International Search Report and Written Opinion for PCT Application No. PCT/US2013/076812, mailed Oct. 10, 2014.
International Preliminary Report on Patentability for PCT Application No. PCT/US2013/076812, mailed Jul. 9, 2015.
European Search Report for European Patent Application No. 13878483 completed Dec. 9, 2015.
* cited by examiner

*Primary Examiner* — Dwayne J White
*Assistant Examiner* — Joshua R Beebe
(74) *Attorney, Agent, or Firm* — Carlson, Gaskey & Olds, P.C.

(57) ABSTRACT

A turbomachine includes a rotor hub that has a central opening there through. A shaft extends through the central opening. A clamp is coupled with the shaft and the rotor hub such that the rotor hub is rotatable with the shaft.

15 Claims, 1 Drawing Sheet

TURBOMACHINE WITH CLAMP COUPLING SHAFT AND ROTOR HUB TOGETHER

STATEMENT REGARDING FEDERALLY SPONSORED RESEARCH OR DEVELOPMENT

This invention was made with government support under contract number DAAH10-02-2-0005 awarded by the United States Army. The government has certain rights in the invention.

BACKGROUND

This disclosure relates to turbomachinery and, more particularly, to the coupling between a rotor hub and a shaft for co-rotation and transfer of energy.

Turbomachines are known and used for transferring energy between a rotor and a working fluid. For example, a turbomachine includes a compressor, a turbine, or both. The rotor can be mounted for co-rotation with a shaft. There are various mechanisms for coupling the rotor and the shaft together, such as splined connections and tie-rod mechanisms. Where the rotor and the shaft are made of similar materials, thermally-induced stresses through the coupling mechanism may be nominal or can be relatively easily managed. However, if the rotor and the shaft are made of dissimilar materials, thermally-induced stresses can exceed the strength limits of the materials.

SUMMARY

A turbomachine according to an exemplary aspect of the present disclosure includes a rotor hub including a central opening there through, a shaft extending through the central opening, and a clamp coupled with the shaft and the rotor hub such that the rotor hub is rotatable with the shaft.

In a further non-limiting embodiment of any of the foregoing examples, the clamp is frictionally coupled with the rotor hub.

In a further non-limiting embodiment of any of the foregoing examples, the rotor hub is non-metallic and the shaft is metallic.

In a further non-limiting embodiment of any of the foregoing examples, the rotor hub is a ceramic material and the shaft is a superalloy material.

A further non-limiting embodiment of any of the foregoing example includes a compliant layer between the rotor hub and the clamp, and the compliant layer is selected from the group consisting of platinum metal, gold metal and combinations thereof.

In a further non-limiting embodiment of any of the foregoing examples, the clamp includes an engagement surface bearing against the rotor hub, and the engagement surface is sloped at an oblique angle with respect to an axis of rotation of the rotor hub.

In a further non-limiting embodiment of any of the foregoing examples, the engagement surface is frusto-conical.

In a further non-limiting embodiment of any of the foregoing examples, the rotor hub includes an axially-flared lip around the central opening onto which the clamp is coupled.

A further non-limiting embodiment of any of the foregoing examples includes an axially-extending passage between the rotor hub and the shaft.

In a further non-limiting embodiment of any of the foregoing examples, the clamp includes cooling passages in fluid communication with the axially-extending passage.

In a further non-limiting embodiment of any of the foregoing examples, the rotor hub includes a plurality of blades on an outer periphery thereof.

An integrally bladed rotor hub and attachment for a turbomachine according to an exemplary aspect of the present disclosure includes a non-metallic rotor hub extending between a first and second axial side, the non-metallic rotor hub includes a lip extending around central opening, a metallic shaft extending through the central opening, and a clamp is coupled with the shaft. The clamp includes a first clamp member arranged on the first axial side of the non-metallic rotor hub and a second clamp member arranged on the second axial side of the non-metallic rotor hub. The first clamp member and the second clamp member engage the lip such that the non-metallic rotor hub is rotatable with the metallic shaft.

In a further non-limiting embodiment of any of the foregoing examples, the non-metallic rotor hub is a ceramic material and the metallic shaft is a superalloy material.

In a further non-limiting embodiment of any of the foregoing examples, the first clamp member has a first engagement surface and the second clamp member has a second engagement surface, and the first engagement surface slopes at a first oblique angle with respect to an axis of rotation of the non-metallic rotor hub and the second engagement surface slopes at a second oblique angle with respect to the axis of rotation of the rotor hub.

In a further non-limiting embodiment of any of the foregoing examples, the first oblique angle is unequal to the second oblique angle.

In a further non-limiting embodiment of any of the foregoing examples, the first oblique angle and the second oblique angle are, independently of each other, less than 50°.

In a further non-limiting embodiment of any of the foregoing examples, the lip is axially-flared.

A method of operating a turbomachine according to an exemplary aspect of the present disclosure includes providing a rotor hub which includes a central opening there through, a shaft extending through the central opening, and a clamp coupled with the shaft and the rotor hub, rotating one of the shaft or the rotor hub to produce a rotational force, and transferring the rotational force through the clamp to the other of the rotor hub or the shaft to co-rotate the rotor hub and the shaft.

In a further non-limiting embodiment of any of the foregoing examples, the transferring of the rotational force includes frictionally transferring the rotational force.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
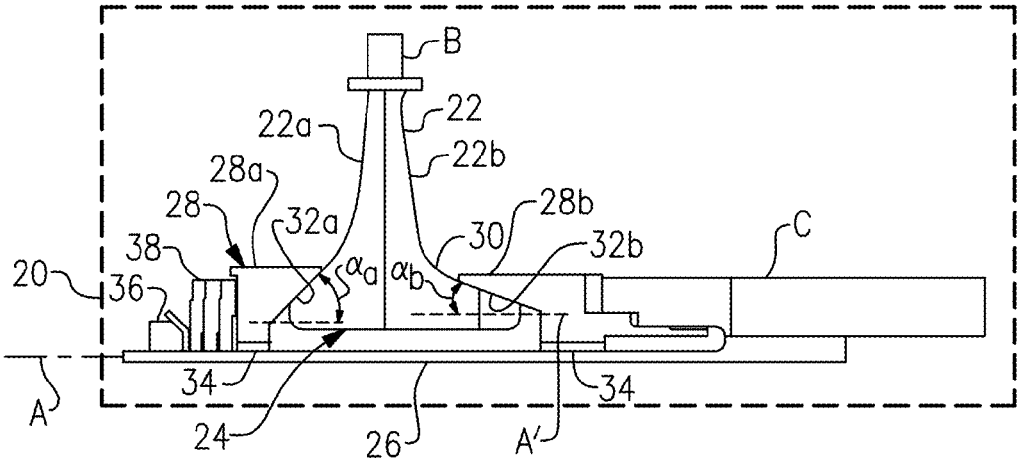
FIG. 1 illustrates an example turbomachine having a clamp coupled with a shaft and a rotor hub such that the rotor hub is rotatable with the shaft.
Figure 2:
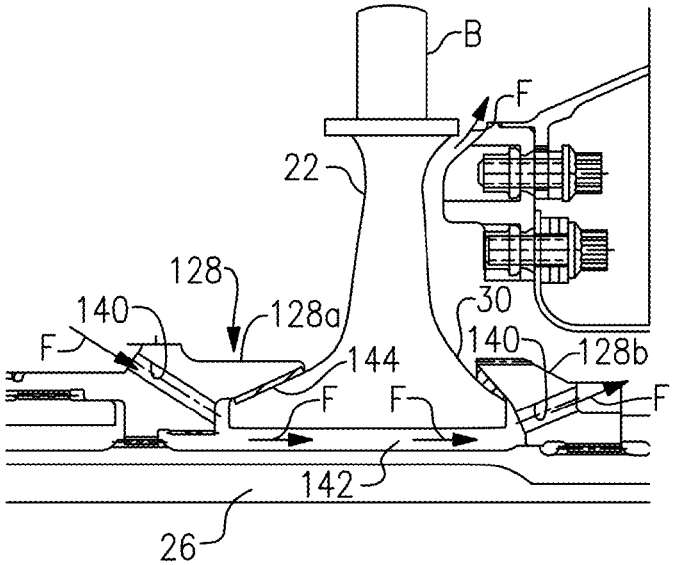
FIG. 2 illustrates another example turbomachine having a clamp that provides for internal cooling passages.

FIG. 1 schematically illustrates a sectioned view of an example turbomachine 20 taken along a central, rotational axis A. FIG. 2 illustrates a half section-view of the turbomachine 20. As can be appreciated, the example turbomachine machine 20 can be a gas turbine engine, such as a ground-based engine, propulsion engine or auxiliary power engine, a pump, an air cycle machine or other type of turbomachine.

Turbomachines are configured to transfer energy between a rotor and a working fluid.

In this example, the turbomachine 20 includes a rotor hub 22 that is generally rotatable about the central axis A. The rotor hub 22 can be an integrally bladed rotor hub that has a plurality of blades B or, alternatively, can include mounting features for separately mounting the blades B. The rotor hub 22 includes a central opening 24 through which a shaft 26 extends. A clamp 28 is coupled with the shaft 26 and the rotor hub 22 such that the rotor hub 22 is rotatable with the shaft 26.

In this example, the clamp 28 includes a first clamp member 28*a* and a second clamp member 28*b*. With respect to the central axis A, the rotor hub 22 includes a first axial side 22*a* and a second axial side 22*b*. The first clamp member 28*a* is arranged on the first axial side 22*a* of the rotor hub 22, and the second clamp member 28*b* is arranged on the second axial side 22*b* of the rotor hub 22. The rotor hub 22 includes a lip 30 that is axially-flared. The first clamp member 28*a* and the second clamp member 28*b* engage the lip 30.

The first clamp member 28*a* and the second clamp member 28*b* include, respectively, engagement surfaces 32*a*/32*b* that bear against the lip 30 of the rotor hub 22. The engagement surfaces 32*a*/32*b* are sloped at respective oblique angles, $\alpha_a/\alpha_b$, with respect to the central axis A of rotation of the rotor hub 22 such that each of the engagement surfaces 32*a*/32*b* is frusto-conical. In the illustrated example, the oblique angles $\alpha_a/\alpha_b$ are unequal. The use of unequal oblique angles $\alpha_a/\alpha_b$ permit the steeper one of the engagement surfaces 32*a*/32*b*, which here is the engagement surface 32*a*, to be axially shorter to provide a more compact arrangement, for example. In a further example, the oblique angles $\alpha_a/\alpha_b$ are, independently of each other, less than 50°. In one further example, the oblique angle $\alpha_a$ is or is about 45° and the oblique angle $\alpha_b$ is about 10°.

The first clamp member 28*a* and the second clamp member 28*b* are mounted on the shaft 26 at splined interconnections 34. In this example, a nut 36 and washers 38, such as Belleville washers, are secured on the shaft 26 to tighten the first clamp member 28*a* and the second clamp member 28*b* around the lip 30 of the rotor hub 22. Upon tightening, the engagement surfaces 32*a*/32*b* frictionally engage the lip 30. Upon rotation of the shaft 26 or the rotor hub 22, the rotational force provided is transferred through the clamp 28 to the other of rotor hub 22 or the shaft 26 to co-rotate the rotor hub 22 and the shaft 26. For example, the frictional engagement provided by the clamp 28 is the exclusive coupling and transfer mechanism between the rotor hub 22 and the shaft 26. In a turbine, the rotor hub 22 (e.g., a turbine rotor hub) would drive rotation of the shaft 26, such as to drive a compressor C. Alternatively, in a compressor, the shaft 26 would drive rotation of the rotor hub 22 22 (e.g., a compressor rotor hub).

Due to a difference in the coefficients of thermal expansion between non-metallic and metallic materials, couplings between dissimilar materials in a turbomachine can generate high thermal stresses on the materials. For example, although ceramic material is relatively strong in compression, it can be brittle in tension. Thus, couplings that thermally-induce tensile loads on ceramic components can debit the lifetime of the component and can preclude the use of ceramic materials for rotor hubs. However, the clamp 28 fastens the rotor hub 22 in compression and thus permits the rotor hub 22 to be made of a ceramic material, while the shaft 26 and the clamp 28 can be made of a metallic material, such as superalloy materials. As can be appreciated however, the clamp 28 is not limited to use where the rotor hub 22 is ceramic material and can also be used where the rotor hub 22 and the shaft 26 are similar or identical materials or with other dissimilar metallic or non-metallic materials.

FIG. 2 illustrates a modified example with a clamp 128 that includes cooling passages 140. In this disclosure, like reference numerals designate like elements where appropriate and reference numerals with the addition of one-hundred or multiples thereof designate modified elements that are understood to incorporate the same features and benefits of the corresponding elements. An axial passage 142 is provided between the rotor hub 22 and the shaft 26. The cooling passages 140 of the clamp 128 are in a fluid communication with the axial passage 142. A cooling flow F can be provided through the cooling passages 140 into the axial passage 142. In this example, the cooling flow F exits through the second clamp member 128*b*. The cooling flow F can then be purged upwardly and adjacent the blade B to limit or prevent relatively hot gas flow from bypassing the blade B and flowing toward the clamp 128.

Additionally, a compliant layer 144 is arranged between the lip 30 of the rotor hub 22 and the clamp 128. For example, the compliant layer 144 is a metallic material, such as platinum metal, gold metal or a combination thereof. The compliant layer 144 is soft relative to the materials of the rotor hub 22 and the clamp 128. Thus, the compliant layer 144 can deform to accommodate thermal growth between the rotor hub 22 and the clamp 128. Additionally, the compliant layer 144 can serve to distribute stress over the area of the lip 30 such that if there is an imperfection in the rotor hub 22, such as a void or micro-crack, the stress will not be concentrated at the imperfection.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A turbomachine comprising:

a rotor hub extending between a first and second axial side, the rotor hub including a lip extending around a central opening there through;

a shaft extending through the central opening; and a clamp coupled with the shaft and the rotor hub, the clamp including a first clamp member arranged on the first axial side of the rotor hub and a second clamp member arranged on the second axial side of the rotor hub, the first clamp member and the second clamp member engaging the lip such that the rotor hub is rotatable with the shaft, wherein the first clamp member has a first engagement surface and the second clamp member has a second engagement surface, the first engagement surface sloping at a first oblique angle with respect to an axis of rotation of the rotor hub and the second engagement surface sloping at a second oblique angle with respect to the axis of rotation of the rotor hub, and the first oblique angle is unequal to the second oblique angle.

2. The turbomachine as recited in claim 1, wherein the clamp is frictionally coupled with the rotor hub.

3. The turbomachine as recited in claim 1, wherein the rotor hub is non-metallic and the shaft is metallic.

4. The turbomachine as recited in claim 3, wherein the rotor hub is a ceramic material and the shaft is a superalloy material.

5. The turbomachine as recited in claim 4, further including a compliant layer between the rotor hub and the clamp, and the compliant layer is selected from the group consisting of platinum metal, gold metal and combinations thereof.

6. The turbomachine as recited in claim 1, wherein the lip is axially-flared around the central opening.

7. The turbomachine as recited in claim 1, further including an axially-extending passage between the rotor hub and the shaft.

8. The turbomachine as recited in claim 7, wherein the clamp includes cooling passages in fluid communication with the axially-extending passage.

9. The turbomachine as recited in claim 1, wherein the rotor hub includes a plurality of blades on an outer periphery thereof.

10. An integrally bladed rotor hub and attachment for a turbomachine, comprising:

a non-metallic rotor hub extending between a first and second axial side, the non-metallic rotor hub including a lip extending around central opening;

a metallic shaft extending through the central opening; and a clamp coupled with the shaft, the clamp including a first clamp member arranged on the first axial side of the non-metallic rotor hub and a second clamp member arranged on the second axial side of the non-metallic rotor hub, the first clamp member and the second clamp member engaging the lip such that the non-metallic rotor hub is rotatable with the metallic shaft, wherein the first clamp member has a first engagement surface and the second clamp member has a second engagement surface, the first engagement surface sloping at a first oblique angle with respect to an axis of rotation of the non-metallic rotor hub and the second engagement surface sloping at a second oblique angle with respect to the axis of rotation of the rotor hub, and the first oblique angle is unequal to the second oblique angle.

11. The integrally bladed rotor hub and attachment as recited in claim 10, wherein the non-metallic rotor hub is a ceramic material and the metallic shaft is a superalloy material.

12. The integrally bladed rotor hub and attachment as recited in claim 10, wherein the first oblique angle and the second oblique angle are, independently of each other, less than 50°.

13. The integrally bladed rotor hub and attachment as recited in claim 10, wherein the lip is axially-flared.

14. A method of operating a turbomachine, the method comprising:

providing a rotor hub including a central opening there through, a shaft extending through the central opening, and a clamp coupled with the shaft and the rotor hub, wherein the rotor hub extends between a first and second axial side and includes a lip that extends around the central opening, and the clamp includes a first clamp member arranged on the first axial side of the non-metallic rotor hub and a second clamp member arranged on the second axial side of the non-metallic rotor hub, the first clamp member and the second clamp member engaging the lip, wherein the first clamp member has a first engagement surface and the second clamp member has a second engagement surface, the first engagement surface sloping at a first oblique angle with respect to an axis of rotation of the rotor hub and the second engagement surface sloping at a second oblique angle with respect to the axis of rotation of the rotor hub, and the first oblique angle is unequal to the second oblique angle;

rotating one of the shaft or the rotor hub to produce a rotational force; and transferring the rotational force through the clamp to the other of the rotor hub or the shaft to co-rotate the rotor hub and the shaft.

15. The method as recited in claim 14, wherein the transferring of the rotational force includes frictionally transferring the rotational force.

* * * * *